United States Patent [19]

Czech et al.

[11] Patent Number: 4,972,687

[45] Date of Patent: Nov. 27, 1990

[54] WASHER/DRYER CONFIGURATION

[75] Inventors: James I. Czech, Lincoln Township, Berrien County; Gerald L. Kretchman, St. Joseph Township, Berrien County; James R. Mulder, Berrien Township, Berrien County; Carl E. Eichman, Lincoln Township, Berrien County, all of Mich.

[73] Assignee: Whirlpool Corporation, Benton Harbor, Mich.

[21] Appl. No.: 462,237

[22] Filed: Jan. 9, 1990

[51] Int. Cl.[5] ..... D06F 29/02

[52] U.S. Cl. ..... 68/3.00 R; 68/20

[58] Field of Search ..... 68/3 R, 19.2, 20, 26

[56] References Cited

U.S. PATENT DOCUMENTS

| | | | |
|---|---|---|---|
| 2,871,688 | 2/1959 | Geldhof | 68/19.2 |
| 3,545,235 | 12/1970 | Menk | 68/19.2 |
| 3,824,813 | 7/1974 | Davis | 68/19.2 X |
| 4,507,942 | 4/1985 | Hirose et al. | 68/20 |
| 4,535,610 | 8/1985 | Fey et al. | 68/3 R |
| 4,785,643 | 11/1988 | Werner | 68/3 R |

*Primary Examiner*—Philip R. Coe

*Attorney, Agent, or Firm*—Hill, Van Santen, Steadman & Simpson

[57] ABSTRACT

A combined appliance for washing and drying laundry of the over/under type. The appliance includes a washer tub wherein the ratio of the tub diameter to the tub depth is approximately 1.3, and further includes a dryer having a drum wherein the ratio of the drum diameter to the drum depth is approximately 1.3. A washer basket is disposed in the washer tub, and the ratio of the dryer drum volume to the capacity of the washer basket is approximately 2.4. The volume of the dryer drum is greater than 4 cubic feet, and the washer basket capacity is greater than 2 cubic feet. The rearwardmost extent of the washer tub is closer to a vertical centerline of the dryer drum than to a rear of the dryer drum, thus enhancing access to the interior of the washer and facilitating transfer of the laundry from the washer to the dryer.

20 Claims, 2 Drawing Sheets

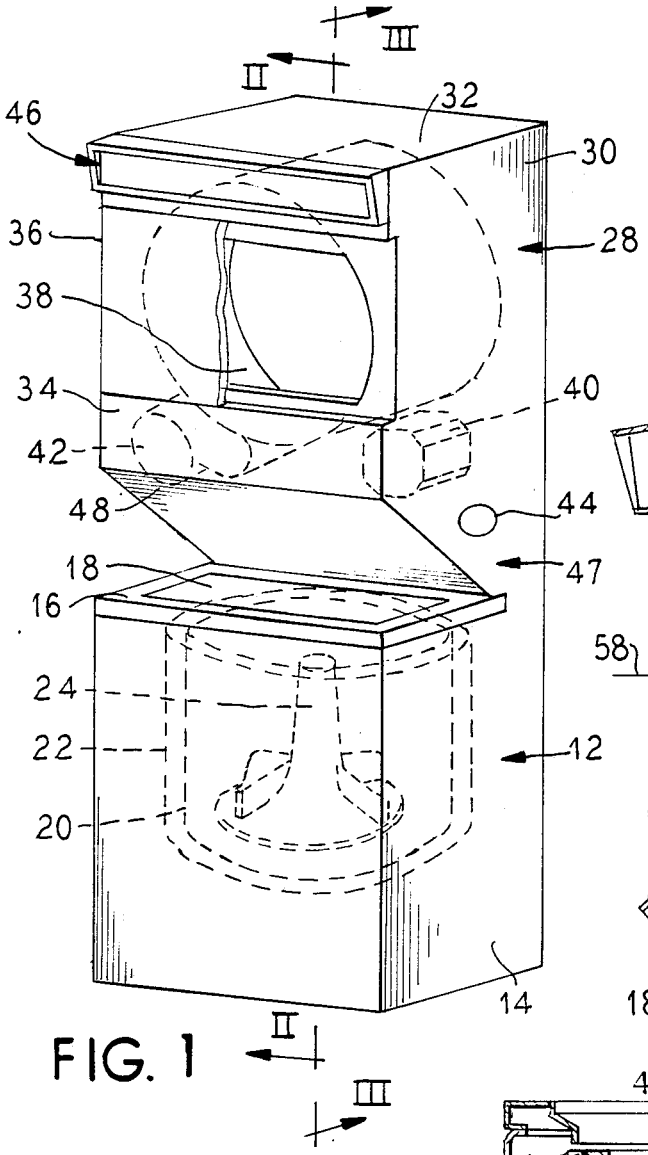
FIG. 1
FIG. 2
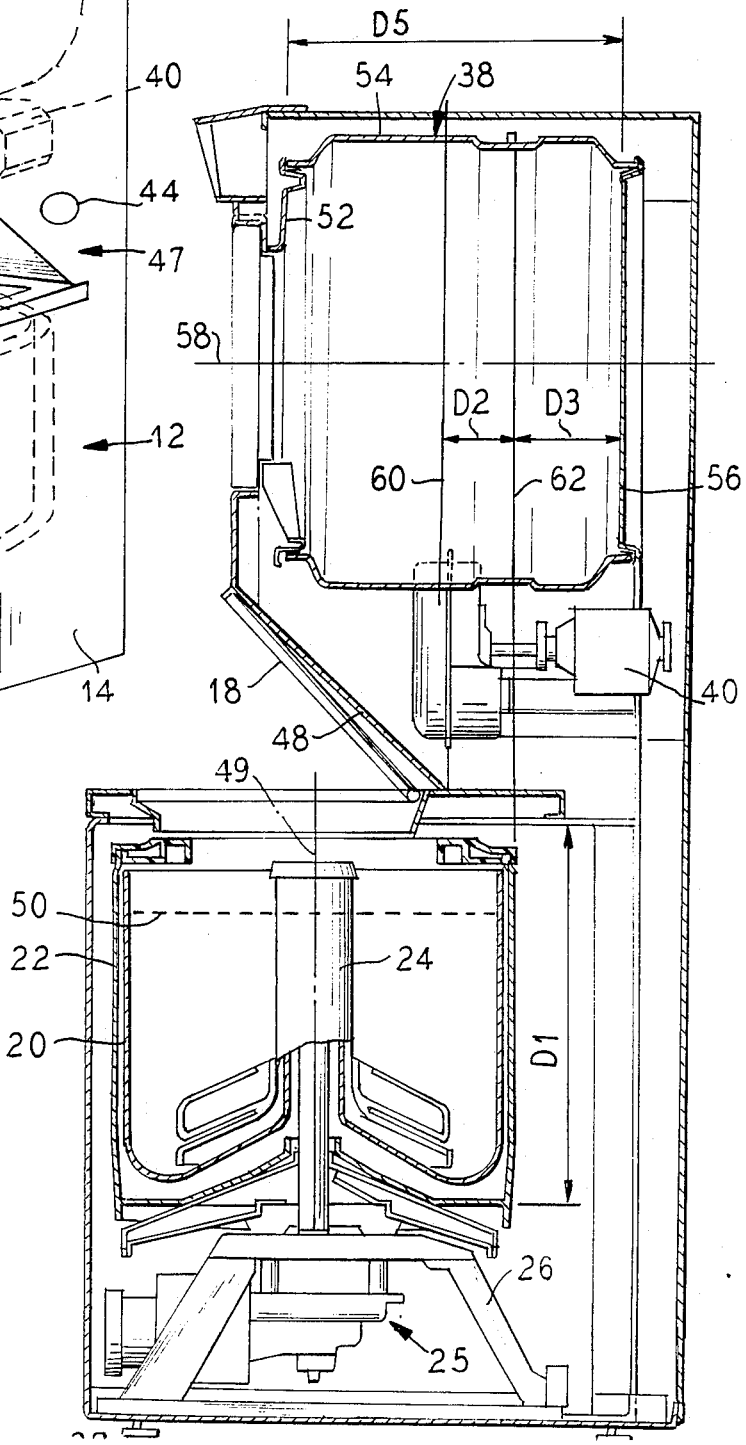

WASHER/DRYER CONFIGURATION

CROSS REFERENCE TO RELATED APPLICATION

This application is related to commonly assigned and copending application Ser. No. 350,725 filed 12 May 1989, the specification of which is incorporated herein by reference.

TECHNICAL FIELD

The present invention relates to a combined home appliance consisting of a washer and dryer inside the same outer cabinet.

BACKGROUND OF THE INVENTION

It is known to combine a washer and dryer in a stacked arrangement inside the same outer cabinet. Such washer/dryer combinations are known as "over-/unders", and are particularly useful for consumers who lack the space for a full size washer and dryer pair. To conserve floor space, the dryer section of the over-/under is suspended above the washer by a framework. Over/unders usually have outer dimensions that allow them to be installed in limited spaces, for example in closets.

In the past, over/unders offered only a fraction of the load capacity of full size machines, thus making them impractical to serve the needs of many potential users. Recently, efforts have been directed to designing over-/unders having a "standard" capacity (also called "large" capacity in the industry). The design of large capacity over/unders presents significant problems in comparison to known small capacity designs. The outside cabinet dimensions may be only slightly increased, due to the need to fit the appliance into limited spaces. However, the internal capacities must be increased greatly to accommodate larger loads. Additionally, the interior of the washer basket and the dryer drum must remain readily accessible to a maximum number of potential users.

The problem of accessibility is compounded by the preference of many consumers, particularly those in the U.S., for vertical axis washers. Vertical axis washers require significant overhead clearance to provide access to the interior of the washer. In an over/under arrangement, this usually means that either the size of the appliances must be reduced, thus reducing capacity, or that the dryer must be mounted at an elevation to accommodate the clearance, thus unacceptably increasing the overall height of the over/under.

Several large capacity over/unders have been designed and marketed. However, these over/unders have incorporated design compromises that have resulted in unsatisfactory performance and limited accessibility. Some manufacturers have resorted to using unconventional designs employing a tilt-out or slide-out washer, thus eliminating the need to provide space immediately beneath the dryer for access to the washer. Although such designs allow more space for extra dryer capacity, they involve relatively complex and expensive mechanisms to provide washer movement, and lack the stability of rigid-framed conventional over/unders having fixed-position washer assemblies.

As is readily apparent from the foregoing, there exists a need for an over/under embodying an optimal balance between outside dimensions, internal capacity, washing and drying performance, and accessibility.

SUMMARY OF THE INVENTION

The present invention provides a combined appliance for washing and drying laundry that optimizes the balance between the above mentioned considerations. The invention includes a washer tub wherein the ratio of the tub diameter to the tub depth is approximately 1.3, and further includes a dryer having a drum wherein the ratio of the drum diameter to the drum depth is approximately 1.3. A washer basket is disposed in the washer tub, and the ratio of the dryer drum volume to the capacity of the washer basket is approximately 2.4. The volume of the dryer drum is greater than 4 cubic feet, and the washer basket capacity is greater than 2 cubic feet. The rearwardmost extent of the washer tub is closer to the vertical side sectional centerline of the dryer drum than to the rear of the dryer drum, thus enhancing access to the interior of the washer and facilitating transfer of laundry from the washer to the dryer. The appliance is configured such that the ratio of the overall appliance height to the sum of the dryer drum volume and washer tub volume is less than 8.5, and the ratio of overall appliance height to the sum of dryer drum volume plus washer basket capacity is less than 10.0.

The illustrated embodiment of the present invention is a rigid frame over/under including a dryer mounted on top of an automatic washer. The washer and dryer are fixedly attached to a common supporting framework, and are surrounded by a common outer cabinet. The dryer drum and washer basket are of conventional diameter for a "extra large" capacity dryer and washer, but have been reduced in axial measurement to provide an ergonomically improved configuration.

More specifically, the washer is a vertical axis unit having a top mounted lid, a washer tub beneath the lid for containing the wash fluid, a perforated wash basket inside the tub for obtaining the wash load, and an agitator coaxially centered inside the basket and tub for agitating the load. The washer motor and transmission are directly beneath the tub.

The dryer is a horizontal axis unit having a front mounted door, a horizontal drum behind the door for tumbling the load, and a motor and drive assembly which provide rotation for the drum.

The washer is capable of handling a "standard" or "large" capacity load, which requires a wash basket capacity of 2.4 to 2.5 cubic feet. This standard is set by the U.S. Department of Energy, and is not the total volume of the basket, but the volume up to the high water line in the basket. The dryer has adequate capacity to handle a "standard" capacity washer load. Furthermore, drying performance and wrinkling prevention are highly dependent on drum size; generally a larger drum produces better results.

The width of the over/under must be no greater than that of an "extra large" capacity washer (typically 27"), so that it will fit through standard doorways. The height of the apparatus must also be limited to permit movement through doorways or into closets. Depth is also minimized, although this dimensions is somewhat less critical since there are no set standards for closet depth.

The diameter of the dryer drum of the present invention is the same as in an "extra large" capacity dryer, but the depth has been reduced to provide a "standard"

capacity. The overall diameter of the drum is slightly greater than the depth. One benefit of the shallow drum is greater accessibility, since the user need not reach as far into the drum to retrieve laundry.

The washer tub and basket were designed with a diameter slightly larger than their depth, providing the required capacity and adequate space for movement of the load within the basket. The agitator was shortened to fit inside the shallower basket. Typical "standard" capacity washers have a deeper basket and tub with a smaller diameter, and have a narrower (typically 24") cabinet. The tub diameter and basket diameter on the over/under of the present invention are actually the same as the tub and basket diameters in an "extra large" capacity unit, so that they fit inside a 27" wide cabinet. As with the shallow drum of the dryer, the basket provides greater accessibility, since the user need not reach as far into the basket to remove laundry.

The over/under of the present invention is configured so that the height of the lower edge of the dryer door is as low as possible, in order to accommodate users of shorter stature. At the same time, the present invention maximizes the distance between the bottom of the dryer and the top of the washer, to facilitate access to the inside of the washer basket.

To improve access to the inside of the washer, the dryer is offset behind the washer to a greater degree than in conventional designs. The offset between the front of the washer and the front of the dryer is approximately 8.5". In addition to removing obstructions above the washer lid, this design also results in an open space behind the washer for the connection of hoses, wiring, and duct work.

In conventional over/unders, mechanical components for driving and venting the dryer drum are located in the dryer housing. Due to the need for clearance above the washer to provide access to the washer basket, such arrangements usually dictate an awkwardly elevated dryer drum, or the location of the dryer mechanical components above the drum, thus increasing the overall height of the over/under. In the present invention, these components have been placed in a transition portion of the appliance housing between the washer housing and the dryer housing, behind a diagonal panel which slopes down from the lower front panel of the dryer to a location behind the washer lid. This arrangement permits the opening to the dryer drum to be kept as low as possible, thus minimizing liftover height. Even with the larger diameter drum of the present invention, the bottom of the dryer opening is at a height comparable to that of a "small" capacity over/under.

The proportions of the washer basket and the dryer drum, combined with the frontal offset of the washer tub with respect to the dryer, combine to maximize the capacity and volume of the washer and dryer, while minimizing the overall height of the combined appliance. These ends are achieved while still maintaining accessibility to the respective appliances.

Other objects and advantages of the present invention will become apparent upon reference to the accompanying description when taken in conjunction with the following drawings.

BRIEF DESCRIPTION OF THE DRAWINGS

FIG. 1 is a perspective view of an over/under embodying the present invention.

FIG. 2 is a sectional view taken generally along line II—II of FIG. 1.

DETAILED DESCRIPTION OF THE PREFERRED EMBODIMENT

Figure 3:
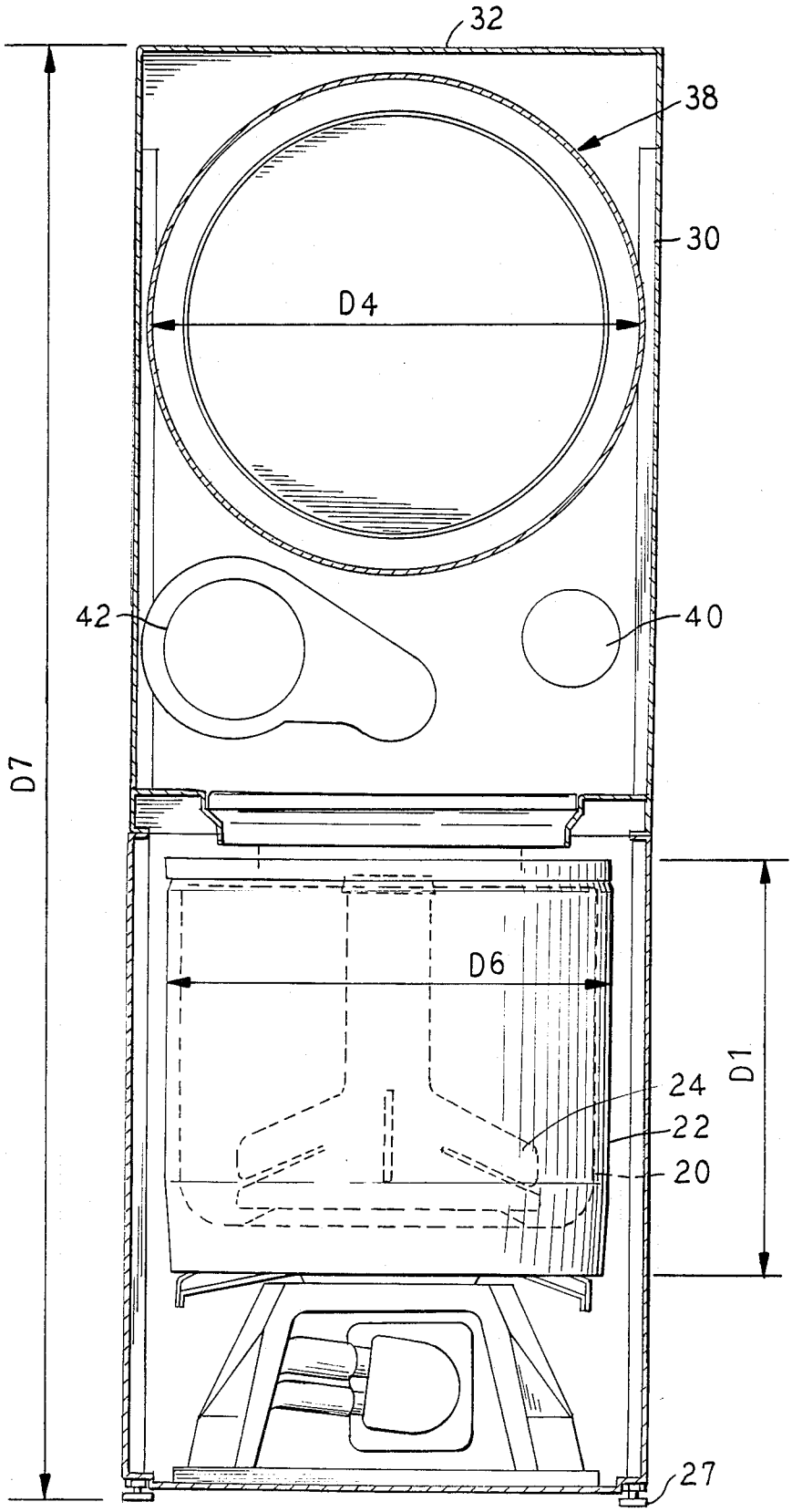
FIG. 3 is a sectional view taken generally along line III—III of FIG. 1.

FIG. 1 shows a combined washing and drying appliance, of the over/under type, generally at 10. The over/under 10 includes a fixed-position washer assembly generally at 12 which is enclosed by side panels 14 and a top panel 16. In the top panel 16, there is a hinged access door 18 which provides access to the interior of the washer assembly 12. The washer assembly 12 houses a perforate wash basket 20 which is concentrically mounted within a wash tub 22. A vertical axis agitator 24 is carried within the wash basket 20, and is selectively driven by a motor/transmission assembly 25. The interior components of the washer assembly 12 are supported on a lower support member 26, and the entire appliance 10 is supported on adjustable leveling legs 27.

A horizontal axis dryer assembly 28 is mounted above the washer assembly 12. The dryer assembly 28 is enclosed by side panels 30 and a top panel 32. A front panel 34 has a hinged door 36 which provides access to the interior of a rotatable dryer drum 38 in which laundry may be placed for drying. The drum 38 may be selectively rotated by an electric motor 40, and an air handling and heating system 42 is provided to supply heated air to the interior of the drum 38. Moist air is exhausted from the appliance 10 through selected openings in the cabinet, shown here as a vent 44. Controls 46 for the appliance 10 are provided on the front panel 34 of the dryer assembly 28.

The washer assembly 12 and the dryer assembly 28 are generally cubic, and are separated by a transition portion 47 of the appliance housing. The transition portion 47 is also generally cubic, but is truncated at one side at an inclined surface 48.

The various dimensional and positional relationships forming a part of the present invention can be seen in FIGS. 2 and 3. The washer basket 20 and the washer tub 22 are arranged concentrically about an axis 49 of the washer 12. The capacity of the washer basket 20, as determined according to U.S. Department of Energy standards, is its volume below its high water line 50. The depth of the tub 22 is measured vertically as shown by distance D1.

The dryer drum 38 includes a front drum wall 52, an outer cylindrical wall 54, and a rear wall 56. The dryer drum 38 rotates about a horizontal axis 58, and defines a vertical side sectional centerline 60.

The rearwardmost extent of the tub 22 occurs at a generally vertically extending plane 62. The vertical plane 62 extends through the dryer drum 38 at a location closer to the centerline 60 than to the rear wall 56, as indicated by distances D2 and D3. This location allows placement of the dryer motor 40 and air handling system 42 in the transition portion 47, thus reducing the overall height of the appliance 10, and also reducing the liftover height required to transfer laundry from the washer 12 to the dryer 28.

In order to optimize accessibility and capacity of the washer 12 and the dryer 28, the ratios of the drum diameter D4 to the dryer depth D2, and the ratio of the tub depth D1 to the tub diameter D6, are selected so that they are approximately 1.3. In this way, the appliance 10 can be made compact in size, without sacrificing usable interior capacity. This enables the overall height D7 of the appliance 10 to be minimized with respect to the sum of the volumes of the dryer drum 28 and the tub 22, and also with respect to the sum of the volume of the dryer drum 28 and the capacity of the wash basket 20. In known prior art over/unders, the former ratio is consistently above 8.5, and the latter ratio consistently above 10.0 . However, in the illustrated embodiment of the present invention, the ratio of overall appliance height to the sum of the volumes of the dryer drum 28 and the tub 22 can be reduced to approximately 7.3, and the ratio of the overall height of the appliance with respect to the sum of the volume of the dryer drum 28 and the capacity of the tub 20 can be reduced to approximately 8.4.

Pertinent dimension of the appliance 10 embodying the present invention are as follows:

| | |
|---|---|
| CABINET | |
| Overall height* (inches) | 72.00 |
| Overall width | 27.00 |
| Overall depth | 32.00 |
| Depth of dryer cab. | 24.00 |
| Height of washer top | 33.13 |
| Height of dryer door bottom above floor | 53.00 |
| DRYER DRUM | |
| Diameter | 26.20 |
| Axial depth | 19.50 |
| Capacity (cubic ft.)** | 6.08 |
| Height of axis above floor | 56.50 |
| Distance from drum center to rear wall | 12.10 |
| WASHER TUB | |
| Diameter | 22.00 |
| Axial depth | 17.40 |
| Volume (cubic ft.)**** | 3.83 |
| Height of tub center above floor | 19.30 |
| Distance from axis to rear wall | 19.30 |
| WASHER BASKET*** | |
| Capacity (cubic ft.) | 2.49 |
| MISCELLANEOUS | |
| Front of drum to rear wall | 21.85 |
| Front of tub to rear wall | 30.30 |
| Front of tub to front of drum | 8.45 |
| Bottom of drum to floor | 43.40 |
| Top of tub to floor | 28.00 |
| Bottom of drum to top of tub | 15.40 |
| RATIO OF: | |
| Tub diameter to tub depth | 1.26 |
| Drum diameter to drum depth | 1.34 |
| Drum volume to tub volume | 1.59 |
| Drum volume to basket volume | 2.44 |
| Overall height to tub volume plus drum volume | 7.27 |
| Overall height to basket volume plus drum volume | 8.4 |

*Assuming leveling legs adjusted to a cabinet height of 1" from floor.
**Dryer drum capacity figure ignores space required by baffles, small depressions, etc.
***Washer basket—maximum usable volume according to DOE.
****Washer tub volume—ignores space required by shaft, tub ring.

Although the present invention has been described with reference to a specific embodiment, those of skill in the art will recognize that changes may be made thereto without department from the scope and spirit of the invention as set forth in the appended claims.

The embodiments of the invention in which an exclusive property or privilege is claimed are defined as follows:

1. A combined appliance for washing and drying laundry comprising the following:

a vertical axis washer assembly including a washer tub having a predetermined diameter and in a predetermined depth such that the ratio of said diameter to said depth, when measured in like units, is approximately 1.3: and a horizontal axis dryer assembly including a dryer drum disposed generally above said washer basket, said dryer drum having a predetermined diameter and a predetermined depth such that the ratio of said diameter to said depth, when measured in like units, is approximately 1.3.

2. A combined appliance according to claim 1, further comprising the following:

a washer basket having a predetermined capacity; and wherein said dryer drum has a predetermined volume such that the ratio of said dryer drum volume to said washer basket capacity, when measured in like units, is greater than 2.0.

3. A combined appliance according to claim 2, further wherein said ratio of said dryer drum volume to said washer basket capacity is in the range of approximately 2.0 to 2.4.

4. A combined appliance according to claim 2, further wherein said washer basket capacity is measured in cubic feet, and is greater than 2 cubic feet.

5. A combined appliance according to claim 2, further wherein said dryer drum has a volume that is measured in cubic feet and is greater than 4 cubic feet.

6. A combined appliance according to claim 1, further wherein:

said appliance has a predetermined height measured in inches;

said washer tub has a first predetermined volume measured in cubic feet; and said dryer drum has a second predetermined volume measured in cubic feet;

the ratio of said predetermined height to the sum of said first and second volumes is less than 8.5.

7. A combined appliance according to claim 1, further comprising the following:

a washer basket disposed within said washer tub and having a predetermined capacity measured in cubic feet;

wherein said washer assembly is a fixed-position washer assembly; and wherein said combined appliance has a predetermined height measured in inches, and said dryer drum has a predetermined volume measured in cubic feet, such that the ratio of said predetermined height to the sum of said volume and said capacity is less than 10.0.

8. A combined appliance according to claim 1, further wherein:

said appliance includes a front surface and a rear surface;

said washer tub includes a rearwardmost extent defined by a generally vertical plane;

said dryer drum includes a central vertical side sectional centerline and a rear wall generally parallel to said vertical plane; and said vertical plane is substantially closer to said central vertical axis than to said rear wall of said dryer drum.

9. A combined appliance according to claim 8, further comprising the following:

a generally cubic dryer drum housing enclosing said dryer drum;

a generally cubic washer housing enclosing said washer tub;

a truncated cubic transition portion between said dryer housing and said washer housing; and motor and air supply means, disposed within said transition portion, for selectively rotating and supplying air to said dryer drum.

10. A combined appliance according to claim 9, further comprising the following:

a washer basket disposed within said washer tub and having a predetermined capacity;

wherein said washer assembly is a fixed-position washer assembly; and wherein said combined appliance has a predetermined height measured in inches, and said dryer drum has a predetermined volume measured in cubic feet, such that the ratio of said predetermined height of said combined appliance to the sum of said volume at said dryer drum and said capacity of said washer basket is less than 10.0.

11. A combined appliance for washing and drying, said combined appliance including front and rear surfaces and comprising the following:

a washer assembly including a washer tub having a rearward-most extent defined by a generally vertical plane;

a dryer assembly including a dryer drum having a central vertical axis and a rear wall generally parallel to said vertical plane; and wherein said vertical plane is substantially closer to said central vertical axis than to said rear wall of said dryer drum.

12. A combined appliance according to claim 11, further comprising the following:

a generally cubic dryer drum housing enclosing said dryer drum;

a generally cubic washer housing enclosing said washer tub;

a truncated generally cubic transition portion between said dryer housing and said washer housing; and motor and air handling means, disposed within said transition housing, for selectively rotating and supplying air to said dryer drum.

13. A combined appliance according to claim 11, further comprising the following:

a washer basket disposed within said washer tub and having a predetermined capacity measured in cubic feet;

wherein said washer assembly is a fixed-position washer assembly; and wherein said combined appliance has a predetermined height measured in inches, and said dryer drum has a predetermined volume measured in cubic feet, such that the ratio of said predetermined height of said combined appliance to the sum of said volume of said dryer drum and said capacity of said washer basket is less than 10.0.

14. A combined appliance according to claim 11, further wherein:

said appliance has a predetermined height, measured in inches;

said washer tub has a first predetermined volume measured in cubic feet;

said dryer drum has a second predetermined volume measured in cubic feet;

and the ratio of said predetermined height to the sum of said first and second volume is less than 8.5.

15. A combined appliance according to claim 14, further comprising the following:

a washer basket disposed within said washer tub and having a predetermined capacity measured in cubic feet;

wherein said washer assembly is a fixed-position washer assembly and wherein said combined appliance has a predetermined height measured in inches, and said dryer drum has a predetermined volume measured in cubic feet, such that the ratio of said predetermined height of said combined appliance to the sum of said volume of said dryer and said capacity of said washer basket is less than 10.0.

16. A combined appliance for washing and drying; said appliance having a predetermined height measured in inches and comprising the following:

a washer assembly including a washer tub having a first predetermined volume measured in cubic feet;

a dryer assembly including a dryer drum having a second predetermined volume measured in cubic feet; and wherein the ratio of said predetermined height to the sum of said first and second predetermined volumes is less than 8.5.

17. A combined appliance according to claim 16, further wherein said ratio of said predetermined height to the sum of said predetermined volumes is in the range of approximately 8.5 to 7.3.

18. A combined appliance according to claim 16, further comprising the following:

a washer basket disposed within said washer tub and having a predetermined capacity measured in cubic feet;

wherein said washer assembly is a fixed-position washer assembly; and wherein the ratio of said predetermined height of said combined appliance to the sum of said volume of said dryer drum and said capacity of said washer basket is less than 10.0.

19. A combined appliance for washing and drying, said appliance having a predetermined height measured in inches and comprising the following:

a fixed position vertical axis washer including a washer basket having a predetermined capacity measured in cubic feet;

a dryer assembly disposed generally above said washer and including a dryer drum having a predetermined volume measured in cubic feet; and wherein the ratio of said predetermined height of said combined appliance to the sum of said volume of said dryer drum and said capacity of said washer basket is less than 10.0.

20. A combined appliance according to claim 19, further wherein said ratio of said predetermined height to the sum of said predetermined volume and said predetermined capacity is in the range of approximately 10.0 to 8.4.

* * * * *